United States Patent [19]

Glasby

[11] 3,991,663

[45] Nov. 16, 1976

[54] OBSERVATION OF MOVING WEBS

[75] Inventor: Francis Goff Glasby, Chesterfield, England

[73] Assignee: Robinson & Sons Limited, Chesterfield, England

[22] Filed: Oct. 7, 1974

[21] Appl. No.: 512,602

[30] Foreign Application Priority Data

Oct. 11, 1973 United Kingdom ..... 47523/73

[52] U.S. Cl. ..... 93/94 R; 83/289; 93/80; 156/193

[51] Int. Cl.[2] ..... B31C 3/00

[58] Field of Search ..... 93/80, 77 R, 94 R; 83/289; 156/193, 195

[56] References Cited

UNITED STATES PATENTS

| | | | |
|---|---|---|---|
| 3,133,483 | 5/1964 | Glasby | 93/80 |
| 3,150,575 | 9/1964 | Couzens et al. | 93/80 |
| 3,158,074 | 11/1964 | Brigham | 93/80 |
| 3,330,186 | 7/1967 | Glasby et al. | 93/80 |
| 3,400,029 | 9/1968 | Mesrobian et al. | 93/80 UX |

FOREIGN PATENTS OR APPLICATIONS

| | | | |
|---|---|---|---|
| 1,022,669 | 1/1958 | Germany | 83/289 |
| 1,087,484 | 10/1967 | United Kingdom | |

*Primary Examiner*—James F. Coan

*Attorney, Agent, or Firm*—Davis, Hoxie, Faithfull & Hapgood

[57] ABSTRACT

A method of observing a moving web having printed thereon a regularly repeated pattern comprising moving said web past at least two photoelectric cells mounted so as to observe simultaneously or substantially simultaneously a predetermined group of control features on the web, and initiating a cutting and/or controlling operation whenever such observation occurs.

10 Claims, 8 Drawing Figures

Figures 1, 2, 3:
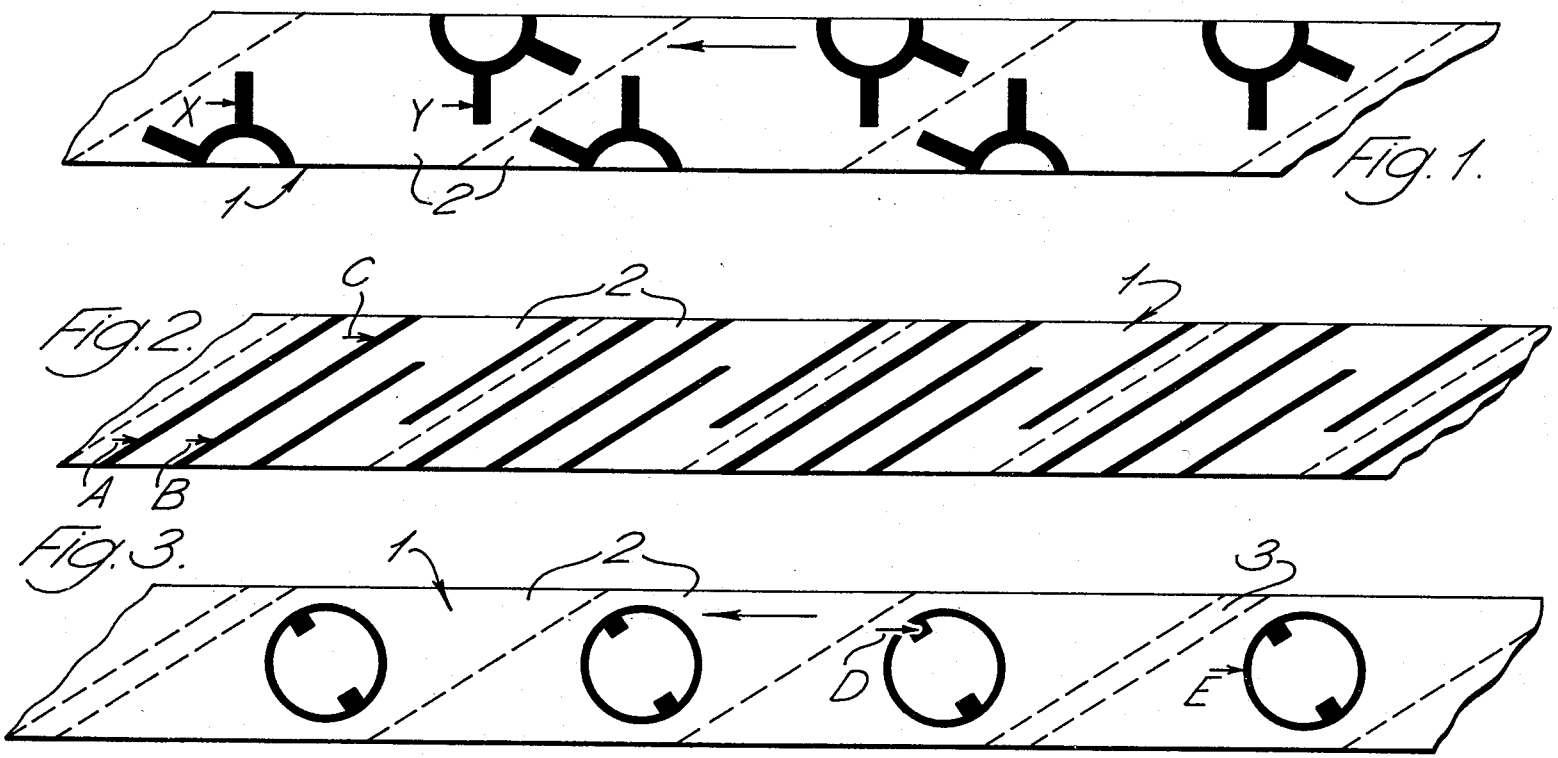

1
2
3
X
Y
A
B
C
D
E

OBSERVATION OF MOVING WEBS

This invention relates to the observation of moving webs and is especially, although not exclusively, concerned with the art of spiral winding and cutting of tubes bearing unitary patterns, these unitary patterns appearing on a constituent web used in the winding of the said tube. Such patterns may be disposed on the said constituent strip and on the subsequently formed tube in forms appropriate for the practising of "Planned trim", "Hidden trim" or "Hybrid trim" techniques, these descriptions being common usage and being exemplified in U.S. Pat. Nos. Re 23,899 (Planned trim) 2,737,091 (Hidden trim) and 3,264,956 (Hybrid trim).

In U.S. Pat. Nos. Re 23,899, 2,734,432, 2,712,778, 2,699,099, 2,623,443, 2,737,091, 3,133,483 and others which describe the spiral winding of tubes, reference is made to the use of control features on the patterned strip to control the cutting of lengths of tube in register with patterns thereon. Typically, the control features are of visual type, detected by photocell means for the purpose of initiating a cutting operation, or modulating or synchronising a cutting phase relationship. The photocell method of detecting control features is the main method currently practised in this field.

Many examples of spirally wound containers show complex patterns from which it would be difficult to detect control features which might be situated therein, and in some cases it is necessary to provide a broad band of marginal material on the printed web, known as "underlap", this under-lap being a convenient place for positioning control features. However, due to the bleed of printed pattern data necessary to prevent mismatching of printed data along the helical joint, the additional width of material required to contain control features without danger of their being confused with printing bleed necessitates a margin width which might be considered not only objectionable in appearance, but also as using excess width of material, which is uneconomic and in some cases might cause deckle problems of a physical and/or economic nature.

An alternative means of applying control features to avoid the danger of operation of the control means by the wrong data is to print a control feature on the reverse side of the printed web. This method, while effective, is expensive in terms of printing costs. In every case an extra printing cylinder is required, and where the number of colour stations is exhausted, then an additional separate run through would be necessary.

A further option which has been used is that of attempting to detect a specific part of the pattern for use as a control feature while overriding other data. This is frequently difficult to achieve, and often necessitates the use of colour filters and other special provision. Such practices are usually very sensitive and frequently cause trouble.

The present invention provides a method which can in many cases, be used to overcome these problems by introducing a system of multiple observation heads, and according to the present invention a method of observing a moving web having printed thereon a regularly repeated pattern comprises moving said web past at least two photoelectric cells mounted so as to observe simultaneously or substantially simultaneously a predetermined group of control features on the web, and initiating a cutting and/or controlling operation whenever such observation occurs.

The method of the invention may be operated in various ways. In one method of operation the photoelectric cells are set up, in relation to the moving web, so that they simultaneously and more or less instantaneously observe the predetermined group of control features, repeatedly at spaced intervals along the web, and the impulse received from the cell-containing circuit when such simultaneous observation occurs is transmitted to the cutter or other control mechanism. The group of control features observed in this mode of operation are preferably areas on the printed web which exhibit a maximum change in contrast, e.g. from dark to light or light to dark. The photoelectric cells thus simultaneously observe the arrival within their range of lines of demarcation between a "dark" zone and a "light" zone or vice versa.

In another basic operating mode, the photoelectric cells are arranged such that one cell will only provide a register impulse if the other cell(s) are already seeing the same light condition. In other words, it is the arrival of a control feature during the simultaneous presence of similar light conditions on the other photoelectric cells, which is the basis of this operating mode.

As will be apparent, the term "control feature" is used to describe any point or area on the printed web which causes a change to occur in the intensity of the light falling on the photoelectric cell, relative to neighbouring points or areas, and which thus causes a change in the resistance of the cell. The selection of the control features is within the judgement of the technician, and is made having regard to the way in which the method is to be carried out, the particular pattern which is printed on the web, the colours thereof, and so on. A trim band separating certain individual patterns from adjacent patterns, and which is used in the practise of the Planned trim technique (see above) may constitute or contain one or more control features.

Conveniently, the multiple simultaneous observations are carried out on the printed web on its way to the winding mandrel. In many complex patterns, it will be possible to select and observe, say, three portions of pattern data which may, or may not, be along the same observing track according to preference or convenience. These three portions of pattern data might for instance be disposed in triangular relationship along the web but are selected so that no other pattern data provides coincidental arrival or presence at the observation heads.

If required, suitable pattern data in a linear or geometrical configuration can be designed into the pattern for purposes of providing such coincidental arrival or presence for control purposes.

In some simple patterns two observing heads only might be required, whereas in more complex patterns three, four, or more observing heads might be required, cooperating with a similar number of control features for purposes of control.

The photoelectric cells will be connected in a circuit, or series of circuits, which responds to the simultaneous observation by the cells of the group of control features in such a way as to initiate a cutting operation or to modulate or synchronise a cutting phase relationship, the manner of initiation or modulation or synchronisation of cutting being known from the specifications mentioned hereinabove, and thus not specifically described herein. Suitably the photocells are connected, by way of individual relays, into a relay circuit which is completed upon the said simultaneous observation occurring and which is responsible for initiating the consequent cutting/controlling operation. The relay circuit remains operative until re-set by a switch which may be operated by a cam associated with the cutter or controlling mechanism and suitably is associated with a time delay on closure so that the relay circuit does not become "alive" again until shortly before the next simultaneous observation is due to occur.

Figure 4:
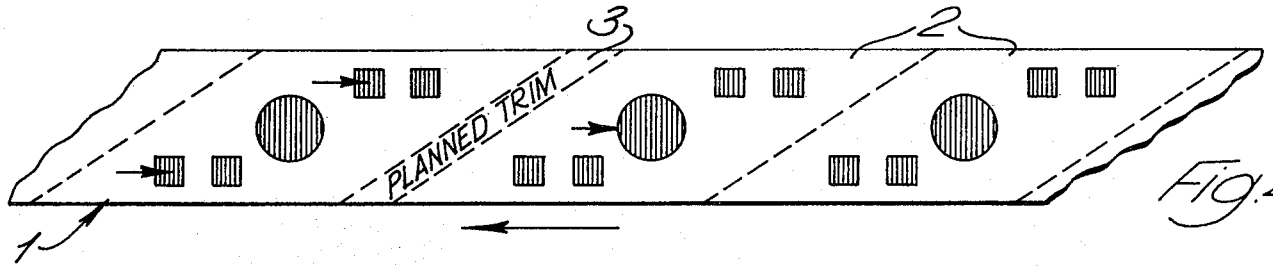
Figure 5:
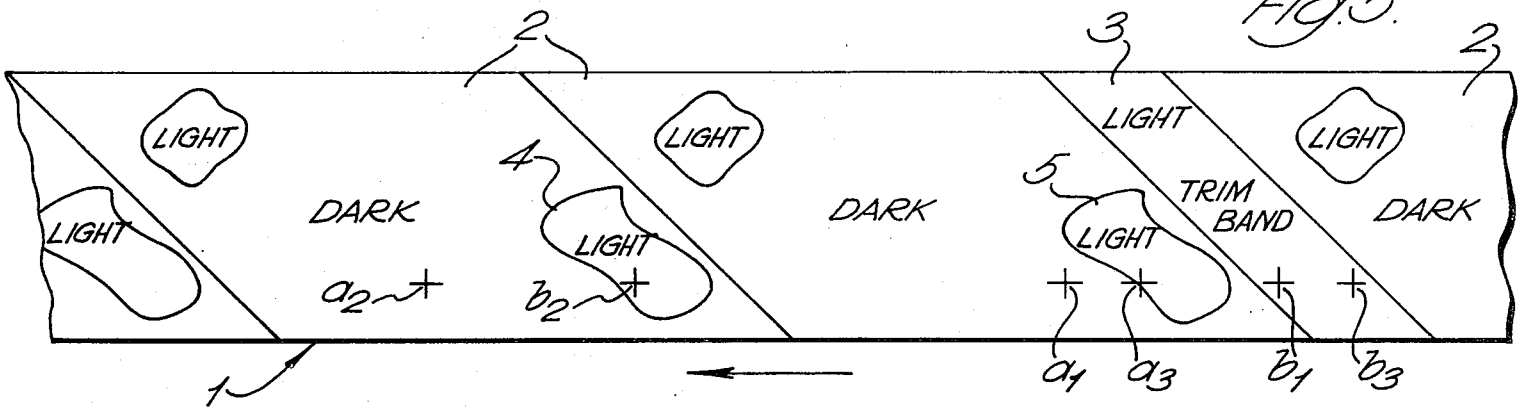
Figure 6:
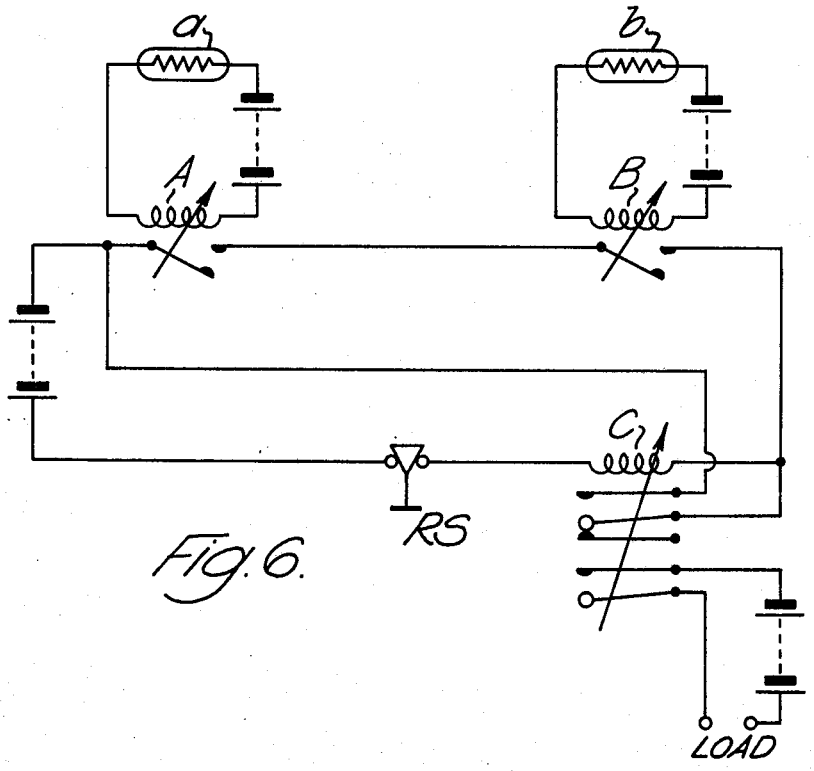
Figure 7:
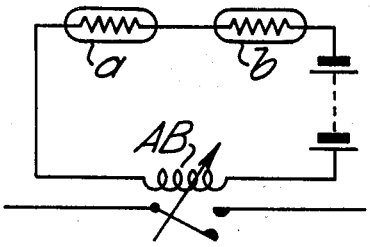
Figure 8:
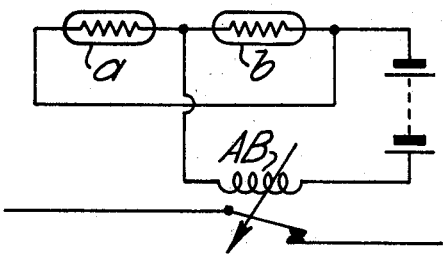

The invention will now be described more specifically with reference to the accompanying drawings, in which:

FIGS. 1 to 5 are diagrammatic plan views of portions of continuously moving webs, having different groups of control features, for simultaneous observation by different photocell set-ups; and FIGS. 6 to 8 are circuit diagrams showing typical circuit lay-outs for the performance of the invention.

Referring to FIGS. 1 to 5, each drawing shows a continuous web 1 having a repeating pattern 2 printed thereon. In the webs of FIGS. 3, 4 and 5, trim bands 3 are provided at spaced intervals along the web, whose direction of movement is shown by the longer arrows. The repeating patterns differ in the five cases illustrated, the exemplify the range of the invention. The photocells, being of standard construction, are not shown in the drawings, but it will be appreciated that they will be arranged to view simultaneously the features described.

FIG. 1 shows a simple spiral layout for the practising of Hidden Trim.

As will be understood from what has previously been stated, it is a requirement of this invention that only one controlling instruction should be derived from each pattern. If only one photocell is used to scan the pattern layout of FIG. 1 and that cell is to be influenced by any part or bit of information in the pattern which passes, there is no place where the cell or observing head could be placed where it would not be influenced by at least two parts or bits of information in the pattern data.

However, if two photocells are used, spaced apart in the direction of movement of the web, both of which cells must be influenced simultaneously or substantially simultaneously, in order to initiate a cutting or controlling operation, and if those cells are placed to make observations at points X and Y as shown in FIG. 1, there is a presentation to the photocells of bits of control information which is not repeated anywhere else except at equivalent locations in each successive pattern. Thus, there will be only one controlling instruction per pattern.

Referring to FIG. 2, a more complex Hidden Trim pattern is shown. In this case there are three positions A, B and C of pre-selected pattern data, serving as control features, which are repeated in similar relationship only in successive patterns. These positions are arranged triangularly so as to be observed by the photocells in three observation heads.

Referring to FIG. 3, where there is shown a simple Planned Trim layout, where it is only required to produce one control instruction for each group of three patterns. In this case the observing heads, are positioned in a manner such that they observe the preselected pattern data simultaneously in positions D and E whilst straddling the trim band 3. This pattern layout being relatively simple, only two observing heads are required.

It will be noted in the case of FIG. 3 due to the presence of the trim band 3, the two patterns which straddle the trim band 3 are farther apart than any other two adjacent patterns. Therefore, the predetermined bits of pattern data occur in the arrangement indicated by D and E (which may be called the triggering arrangement) only in two patterns which are on the opposite sides of a trim band.

In FIG. 4, a more complex Planned Trim layout is shown. There three observing heads are provided so as to receive appropriate control information from the patterns, while they are straddling the trim band 3. In FIG. 4 the triggering arrangement of pattern data is only repeated at distances corresponding to the pitch between the trim bands, for the same reason as explained in connection with FIG. 3.

Where Hybrid Trim layouts are involved, the principles already outlined for Planned Trim can apply.

Again for the purposes of illustration, the circuits shown in FIGS. 6 to 8 include just two photocells, a and b, although it will be appreciated that in order to observe the webs shown in FIGS. 2 and 4, three photocells, suitably connected, will be required.

Referring to FIG. 6, the photocells a and b are contained in relays A and B respectively having output contacts in series with the operating coil of a relay C. Relay C is a trigger-type device designed to operate from a transient impulse and remain operative until re-set by the opening of a switch RS. Relay C is linked (at "Load") to, for example, the tube stick cutter mechanism or other controlling mechanism, in a manner known per se (see for example the specifications referred to hereinabove), and switch RS is conveniently operated by a cam on, for example, the cutter mechanism which causes it to be opened during the cutter cycle. The switch RS is suitably associated with a time delay means which delays switch closure so that the circuit does not again become alive, i.e. conditioned for energization until shortly before the next occurrence of simultaneous observation.

Referring to FIGS. 1 and 6, it will be seen that when photocells a and b are viewing the positions on pattern 2 marked X and Y respectively, each will undergo a change in resistance, since they are both passing from a light zone to a darker zone. This change in resistance causes a pulse in each of the relays A and B, which closes the output contacts of relays A and B, thus completing the circuit of relay C. The cutter mechanism or other control mechanism is thus operated, and the relay circuit is only re-opened when switch RS is opened. The contacts of relays A and B will of course open when the photocells a and b undergo a further change in resistance, i.e. from a dark to a light zone, and are ready for the next simultaneous observation.

The moving webs of FIGS. 2 and 4 may be observed and controlled in similar manner.

With regard to the web shown in FIG. 5, the photocell-operated relay B will in this instance operate as a "gate" for relay A. Thus, when photocell *b* is observing the light-coloured pattern feature 4, as shown at $b_2$, the photocell *a* is observing the dark portion of the pattern, at $a_2$. Thus, relay B is operative but relay A is not, and by the time relay A becomes operative, photocell *a* having passed into the adjacent "light" area 4, photocell *b* has passed into the adjacent "dark" area and relay B is not operative. The relay circuit C is not therefore operated and no consequent operation ensues. The photocells a and b have not simultaneously viewed a light portion of the web.

However, when photocell *b* passes into light band 3 (for instance at $b_1$) relay B becomes operative and remains so while photocell *a* passes into the light portion 5 of the pattern. Both photocells are observing light portions of the web, at $a_3$ and $b_3$ respectively, both relays A and B are operative and the relay C is therefore made operative.

Whilst FIG. 6 shows the inclusion in the circuit of two relays A and B, a single relay AB (FIGS. 7 and 8) can be used to perform their joint function. In FIG. 7 the photocells are in series and the relay AB will operate when both cells simultaneously observe light zones; in FIG. 8 they are in parallel and the relay will operate when they simultaneously observe dark zones.

It should be noted that the invention is not confined to use with single action trigger type cutting machines as particularly described above. Thus, where the invention is used on continuous type machines having a cutter variably geared to the web feed the arrival of the impulse from the photocells can be analysed in the sense of "late", "early" or "correct" arrival by means well known in the art (see for example U.S. Pat. No. 3,133,483) to produce an appropriate or proportional correction of feed of the web or tube, or cutter speed or cutter/web phasing, in order to maintain synchronism.

The manufacture of tubes by spiral winding is described in detail in the following patent specifications — U.S. Pat. No. Re 23,899 and U.S. Pat. Nos. 2,623,443, 2,623,445, 2,699,099, 2,712,778, 2,734,432, 2,737,091, 3,133,483, 3,139,011, 3,150,574, 3,150,575, 3,264,956, 3,330,186; U.K. Specifications Nos. 653,613, 653,615, 661,851, 695,194, 703,981, 743,112, 743,115, 743,116, 743,123, 743,170, 953,683, 980,629, 985,793, and 1,031,585; and Canadian Pat. Nos. 524,423, 568,728, 714,809, 744,157 and 760,710. Reference is directed to these specifications for an understanding of the tube manufacturing methods in conjunction with which the observation technique of the present invention may be used.

What we claim is:

1. The method of initiating an operation associated with the cutting of a web, comprising the steps of observing continuously by means of at least two photoelectric cells a moving web which bears a regularly repeated pattern and a plurality of separate control features spaced lengthwise along the web, causing substantially simultaneous observations of different control features by different cells as said plurality of control features move past said cells, causing activation of an electric circuit in which said cells are connected only when said substantially simultaneous observation occurs, and causing said circuit activation as effectuated by said substantially simultaneous observations to initiate said cutting-associated operation.

2. The method as claimed in claim 1 wherein each of said photocells observes respective control features simultaneously as they arrive within the range of each respective cell.

3. The method as claimed in claim 1 wherein said control features comprise a change in contrast in the pattern printed on the web.

4. A method as claimed in claim 1 wherein the said observations involve the simultaneous presence of each of said group of control features within the range of each respective photoelectric cell.

5. In the method of manufacturing tubular container bodies bearing patterns in register with the ends thereof, the steps comprising helically winding a strip or web bearing along its length a regularly repeated complex variegated pattern and a plurality of at least two spaced separate control features spaced lengthwise along the web, observing continuously by means of at least two photoelectric cells the moving web before said winding, causing substantially simultaneous observations of different control features by different cells as said plurality of control features move past said cells, causing activation of an electric circuit in which said cells are connected only when said substantially simultaneous observation occurs, and causing said circuit activation as effectuated by said substantially simultaneous observations to initiate an operation associated with the cutting of the web.

6. The method as claimed in claim 5 wherein said plurality of separated control features comprise a group with the different control features located in a predetermined arrangement.

7. The method as claimed in claim 6 wherein said observations require simultaneous presence of each control feature of the group within the range of its respective photoelectric cell.

8. The method as claimed in claim 5 in which the cutting-associated operation comprises cutting of the tubing.

9. The method as claimed in claim 5 in which the cutting-associated operation comprises utilizing the circuit activation for comparison of the positional progress of the patterns with the condition of the cutting cycle in determination of the activation of mechanism for controlling the relationship of said positional progress and the cutting.

10. The method as claimed in claim 5 in which the cutting-associated operation comprises variation of the speed of movement of the web.

* * * * *